United States Patent [19]

Hayatdavoudi et al.

[11] 4,436,166

[45] Mar. 13, 1984

[54] DOWNHOLE VORTEX GENERATOR AND METHOD

[75] Inventors: Asadollah Hayatdavoudi; Ladd M. Adams, both of Norman, Okla.

[73] Assignee: Gill Industries, Inc., Meeker, Colo.

[21] Appl. No.: 169,676

[22] Filed: Jul. 17, 1980

[51] Int. Cl.[3] ..... E21B 21/00

[52] U.S. Cl. ..... 175/65; 175/213; 175/324; 175/340

[58] Field of Search ..... 175/65, 231, 324, 339, 175/340, 213, 217, 323, 324, 107, 393, 67, 69

[56] References Cited

U.S. PATENT DOCUMENTS

| | | | |
|---|---|---|---|
| 890,978 | 6/1908 | Hardsocg . | |
| 2,286,528 | 6/1942 | Yost . | |
| 2,340,738 | 2/1944 | Dilley | 175/393 X |
| 2,365,941 | 12/1944 | Crake | 175/393 |
| 2,485,098 | 10/1949 | Johnson . | |
| 2,545,195 | 3/1951 | Crake . | |
| 2,626,780 | 1/1953 | Ortloff . | |
| 2,634,101 | 4/1953 | Sloan . | |
| 2,643,094 | 6/1953 | Peter . | |
| 2,710,741 | 6/1955 | Hall, Sr. . | |
| 2,738,167 | 3/1956 | Williams, Jr. . | |
| 2,765,146 | 10/1956 | Williams, Jr. . | |
| 2,776,115 | 1/1957 | Williams, Jr. . | |
| 2,805,045 | 9/1957 | Goodwin . | |
| 2,861,780 | 11/1958 | Butler . | |
| 2,946,565 | 7/1960 | Williams . | |
| 3,111,179 | 11/1963 | Albers et al. . | |
| 3,144,087 | 8/1964 | Williams, Jr. . | |
| 3,198,256 | 8/1965 | Kirby . | |
| 3,215,215 | 11/1965 | Kellner . | |
| 3,318,397 | 5/1967 | Combes | 175/323 X |
| 3,455,402 | 7/1969 | Tiraspolsky . | |
| 3,566,980 | 3/1971 | Scroggins | 175/65 |
| 3,908,771 | 9/1975 | Garrett . | |
| 3,923,109 | 12/1975 | Williams, Jr. . | |
| 3,958,651 | 5/1976 | Young . | |
| 4,022,285 | 5/1977 | Frank . | |
| 4,083,417 | 4/1978 | Arnold | 175/393 |
| 4,126,194 | 11/1978 | Evans . | |
| 4,222,447 | 9/1980 | Cholet . | |
| 4,223,747 | 9/1980 | Marais . | |
| 4,239,087 | 12/1980 | Castel et al. . | |
| 4,240,513 | 12/1980 | Castel et al. . | |

FOREIGN PATENT DOCUMENTS

| | | | |
|---|---|---|---|
| 590939 | 4/1959 | Italy . | |
| 1477069 | 6/1977 | United Kingdom | 175/340 |

OTHER PUBLICATIONS

Bits Designed to Reduce Bottom-Hole Pressure While Drilling, a thesis submitted to the graduate faculty of the Louisiana State University, Dept. of Petroleum Engineering by Mohamed Sadik Bizanti, Dec. 1978.

Society of Petroleum Engineers, Paper SPE 8379, Allen & Baker, entitled "The Development of Two-Nozzle Enhanced Crossflow Rock Bits", 1979.

Society of Petroleum Engineers, Paper SPE 7516, Cholet and Crausse, entitled "Improved Hydraulics for Rock Bits", 1978.

*Journal of Petroleum Technology,* Nov. 1964, pp. 1299-1306, McLean, "Crossflow and Impact Under Jet Bits".

*Society of Petroleum Engineers Journal,* Aug. 1973, pp. 233-238, Sutko, "Drilling Hydraulics-A Study of Chip Removal Force Under a Full-Size Jet Bit".

*The Oil and Gas Journal,* Mar. 19, 1979, pp. 88-97, Baker, "Extended Nozzle Bits Require Precise Nozzle Sizing".

*Journal of Petroleum Technology,* Aug. 1978, pp. 1191-1198, Pratt, "Increased Penetration Rates Achieved With New Extended Nozzle Bits".

*World Oil,* Oct. 1977, pp. 63-65, Cholet et al., "Unique Bit Design Improves Hydraulics and Performance."

*Journal of Petroleum Technology,* Dec. 1965, pp. 1443-1448, McLean, "Velocities, Kinetic Energy and Shear in Crossflow Under Three-Cone Jet Bits".

*Journal of Petroleum Technology,* Nov. 1971, pp. 1299-1304, Sutko et al., "The Effect of Nozzle Size, Number, and Extension on the Pressure Distribution Under a Tricone Bit".

*Primary Examiner*—Ernest R. Purser

*Attorney, Agent, or Firm*—Laney, Dougherty, Hessin & Beavers

[57] ABSTRACT

A drilling sub is provided in a drill string above a drill bit. The drilling sub includes a nozzle oriented to eject drilling fluid from said drill string into an annulus between the drill string and a well bore hole at an elevation above the drill bit with a horizontal velocity component tangential to said annulus to thereby impart a swirling motion to drilling fluid in the annulus. This creates a vortex extending down to the drill bit to enhance the cleaning of cuttings from the bore hole and to reduce a pressure differential thereby increasing a penetration rate of the drill bit.

47 Claims, 20 Drawing Figures

DOWNHOLE VORTEX GENERATOR AND METHOD

BACKGROUND OF THE INVENTION

This invention relates generally to apparatus for use in drilling oil wells, and more particularly, but not by way of limitation, to a sub for connection to a drill bit, said sub being provided with means for creating an upwardly swirling flow in the well annulus above the drill bit.

During normal drilling operations a drilling fluid generally referred to as drilling mud is pumped down an internal bore of the drill string and out through a plurality of orifices in the rotary drill bit to wash away cuttings and other debris at the interface of the drill bit with the underground formation. This drilling mud then flows upward through the annulus between the drill string and the well bore to carry the cuttings away from the drill bit. Often, if the hydraulic horsepower at the bit (i.e. the fluid flow rate and pressure) is not adequate the bit may ball up due to ground up cuttings sticking on and around the bit teeth. Balling up of the bit causes lower penetration rate, excessive drag, and possible blowout and damaged wellbore.

It is, therefore, important that the design of any drill bit and its associated apparatus provide for hydraulic flow across the interface of the drill bit and the underground formation of a nature sufficient to clean away the cuttings from that interface.

The drilling mud must, however, accomplish another very important task in addition to cleaning cuttings away from the drilling interface.

This second task may generally be described as blowout prevention. The underground formations penetrated by the well borehole often contain very high pressure fluids. If the pressure within the borehole where it intersects the formation is less than the pressure of the fluid in the formation then an uncontrolled blowout may occur wherein high pressure formation fluid flows rapidly into and up the borehole potentially causing damage to drilling equipment and injury to drilling personnel at the surface.

Such blowouts are prevented by maintaining a column of drilling mud within the borehole of sufficient density that the hydrostatic pressure in the borehole at the intersection with any given underground formation is greater than the formation fluid pressure. This difference between hydrostatic pressure in the borehole and formation fluid pressure is commonly called the pressure differential. This pressure differential is typically on the order of several hundred p.s.i., i.e. the hydrostatic pressure of drilling mud within the borehole is several hundred p.s.i. greater than the formation fluid pressure. The pressure differential may be as great as several thousand p.s.i.

The term "pressure differential" as generally utilized in the drilling industry refers to this difference between hydrostatic pressure in the borehole and formation fluid pressure just described. There is, however, another "pressure differential" which is of significance to the following disclosure, namely, the difference between the rock stress (compression stress within the rock formation) and the hydrostatic pressure in the borehole. For purposes of differentiation between the two concepts, the term "fluid pressure differential" is used throughout the remainder of this disclosure to refer to the difference between hydrostatic pressure in the borehole and formation fluid pressure, and the term "rock stress pressure differential" is used to refer to the difference between the rock stress and the hydrostatic pressure in the borehole.

The prior art has recognized that this fluid pressure differential has a detrimental side effect in that it causes a hole-down force on cuttings at the interface between the drill bit and the formation. This hinders the removal of the cuttings and contributes to the problem previously discussed of balling up of the drill bit. The cuttings which are held down by the fluid pressure differential are ground to a paste on top of the unbroken rock formation.

This balling up of the bit and presence of unremoved cuttings at the drilling interface greatly reduces the penetration rate (i.e. the speed at which the well borehole is drilled) as compared to the rate which could be achieved with more complete removal of cuttings.

A thorough summary of the work previously done in this field, which explains the above mentioned problems in greater detail, is found in "Bits Designed To Reduce Bottom-Hole Pressure While Drilling", a thesis submitted to the graduate faculty of the Louisiana State University, Department of Petroleum Engineering, by Mohamed Sadik Bizanti, in December, 1978.

That thesis analyzes several structures which have been proposed to eliminate this problem of pressure differential at the interface of the drill bit and the formation. Those structures are found in U.S. Pat. No. 2,946,565 to Williams; U.S. Pat. No. 4,022,285 to Frank; U.S. Pat. No. 3,958,651 to Young, and U.S. Pat. No. 3,923,109 to Williams, Jr.

U.S. Pat. No. 2,946,565 to Williams proposes a drilling sub having an upward opening annular sealing cup disposed thereabout for sealing against the borehole and supporting a column of fluid above the cup. A jet nozzle diverts a portion of the downward flowing drilling fluid from within the drill string out an upward directed orifice within a passage through the sub which communicates with the annulus both above and below the sealing cup to form a jet pump which reduces the pressure within the annulus below the sealing cup.

U.S. Pat. No. 4,022,285 to Frank proposes a bit incorporating one or more upward directed jet pumps which entirely support the column of drilling fluid surrounding the drill string and provide a dry borehole bottom at the bit-formation interface. The upward movement of the drilling fluid through the jet pump causes a suction which removes the cuttings from the interface. This requires that a relatively small clearance be maintained between the drill string and the borehole immediately above the bit so that the column of fluid thereabove can be supported.

U.S. Pat. No. 3,958,651 to Young proposes to use air rather than drilling mud to carry the cuttings away from the drill bit. The air flows downward through an intermediate annulus contained in the drill string and then back up a central passage. A portion of the downward flowing air is diverted upward into the central passage to provide a jetting effect to aid the upward flow of air.

U.S. Pat. No. 3,923,109 to Williams, Jr. proposes a plurality of horizontally oriented jets directed at the corner between the sidewall of the borehole and the bottom of the borehole to wash away cuttings and a plurality of upwardly directed jets for inducing upward flow of the cuttings.

Another structure similar to those just discussed, but not analyzed in the Bizanti Thesis, is U.S. Pat. No. 2,765,146 to E. B. Williams, Jr. That reference proposes a drilling sub which diverts a portion of the drilling fluid flowing down through the drill string to a radial passage and out an upwardly directed orifice into the annulus between the drill string and the borehole to increase the upward velocity of the drilling fluid in the annulus.

SUMMARY OF THE INVENTION

The present invention provides several embodiments of drilling subs which divert a portion of the downward flowing drilling fluid from the drill string and eject it into the annulus such that it has a velocity component tangential to the annulus so that it imparts a swirling vortex type motion to an annular column of drilling fluid flowing upward around the drilling sub from below.

One embodiment of the drilling sub of the present invention includes a housing having a longitudinal passageway disposed therethrough, with an upper end adapted to be connected to a drill string and with a lower end adapted to be connected to a rotary drill bit. An annular cavity is disposed within the housing of the sub concentric with the longitudinal passageway and spaced radially outward therefrom. A supply passage means is disposed in the housing and communicates the longitudinal passageway with a lower portion of the annular cavity. This supply passage means is oriented at a junction with the annular cavity so that fluid flowing from the supply passage means into the annular cavity has a velocity component tangential to the annular cavity. Spiral guide means are located in the annular cavity for defining a shape of the annular cavity in an upward spiral. The annular cavity has an upwardly decreasing cross-sectional area so that the velocity of the drilling fluid is increased as it moves upward through the annular cavity. An ejection passage means is disposed in the housing at the upper portion of annular cavity with an outer surface of the housing.

Another embodiment of the present invention also includes a housing having a longitudinal passageway disposed therethrough, with upper and lower ends of the housing adapted to be connected to a drill string and a drill bit respectively. A transverse opening is disposed in the housing and communicates the longitudinal passageway with an exterior of the housing. A ceramic nozzle has a cylindrical body sealingly received in said transverse opening. A transverse passage is disposed in the nozzle body and has a first end communicated with said longitudinal passageway and a second end oriented to eject fluid therefrom into an annular space surrounding said housing with a velocity component tangential to said annular space.

It is, therefore, a general object of the present invention to provide an improved drilling sub for connection of a rotary drill bit to a drill string.

Another object of the present invention is the provision of a sub including means for imparting an upwardly swirling motion to drilling fluid in the annulus above the drilling bit.

Yet another object of the present invention is the provision of a drilling apparatus including means for imparting an upwardly swirling motion to a first portion of drilling fluid taken from the interior of a drill string and for injecting said upwardly swirling first portion of drilling fluid into an annulus between the drilling apparatus and a well hole for thereby imparting an upwardly swirling motion to drilling fluid in the annulus.

And another object of the present invention is the provision of a drilling sub for decreasing a hydrostatic pressure exerted upon the underground formation which is being cut by the drill bit.

And another object of the present invention is the provision of a drilling sub for decreasing the effective circulating density of drilling fluid near the drill bit.

And another object of the present invention is the provision of a drilling sub which allows a drill bit to drill faster and easier into an underground formation.

Still another object of the present invention is the provision of apparatus for generating a vortex extending down to the drill bit.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 8 is a view similar to FIG. 2 showing another modified version of the embodiment of FIG. 2.

FIG. 9 is a view similar to FIG. 2 showing yet another modified version of the embodiment of FIG. 2.

DETAILED DESCRIPTION OF THE PREFERRED EMBODIMENTS OF THE INVENTION

Figure 1:
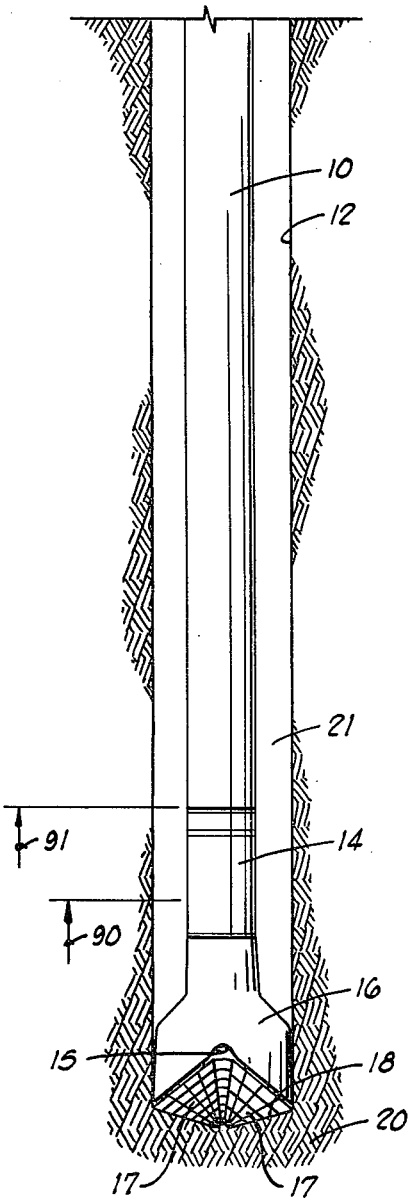
FIG. 1 is a schematic elevation view of a rotary drill string with a drilling sub and rotary drill bit attached thereto in place within a well borehole.

Referring now to the drawings, and particularly to FIG. 1, a drill string 10 is shown in place within a well borehole 12.

Those skilled in the art will understand that the drill string 10 is comprised of a plurality of pipe seqments and other apparatus threadedly connected together and rotated by a rotary drilling rig located at the ground surface.

Connected to the lower end of the drilling string 10 is the drilling sub 14 of the present invention, to the lower end of which is connected a rotary drill bit 16. The drilling sub 14 itself may be considered to be a part of drill string 10. The cutting edge of the drill bit 16 is shown in contact with a face 18 of an underground formation 20 into which the drill bit 16 drills as the drill string 10 is rotated.

Defined between the drill string 10 and the borehole 12 is an annulus 21.

During typical drilling operations without the drilling sub 14 of the present invention, drilling mud is pumped down an internal bore of the drill string 10 and flows out jet openings 15 between the cutting cones 17 of the drill bit 16 so as to flush away cuttings and other debris from the teeth of the cones and from the interface between the drill bit 16 and the face 18 of the formation 20. That drilling fluid then flows back upward through the annulus 21 to carry the cuttings away from the drill bit 16.

EMBODIMENTS OF FIGS. 2-9

Figure 2:
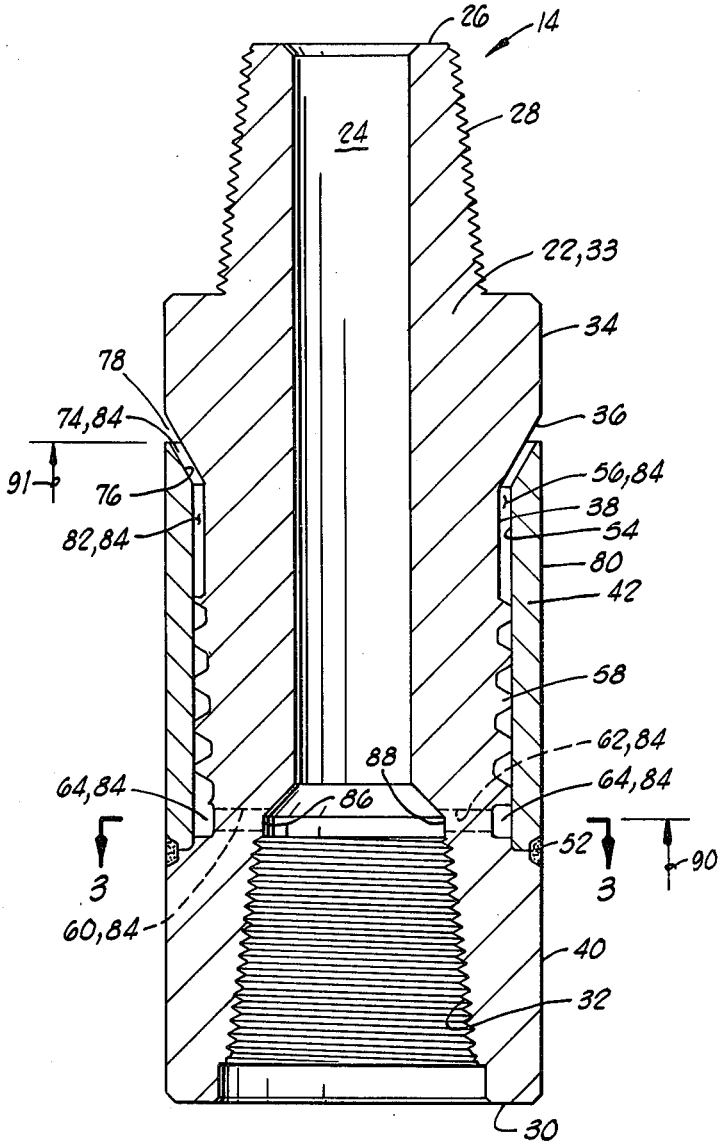
FIG. 2 is an elevation section view of the drilling sub of the present invention.

Referring now to FIG. 2, a sectional elevation view of the drilling sub 14 is thereshown.

The sub 14 includes a housing 22 having a longitudinal passageway 24 disposed therethrough. An upper end 26 of housing 22 is adapted to be connected to drill string 10 at a threaded pin connection 28. A lower end 30 of housing 22 is adapted to be connected to drill bit 16 at a threaded box connection 32.

Housing 22 includes an inner spool portion 33 and a cylindrical outer housing shell 42.

Spool portion 33 of housing 22 includes an upper cylindrical surface 34, a downwardly inwardly tapered annular surface 36, a downward and slightly inwardly tapered annular surface 38, and a lower cylindrical surface 40.

Figure 3:
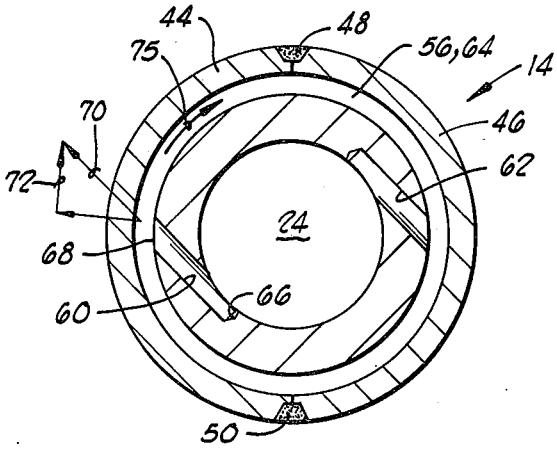
FIG. 3 is a sectional view taken along line 3—3 of FIG. 2.

Outer housing shell 42 is formed from two semi-cylindrical halves 44 and 46 as shown in FIG. 3. Halves 44 and 46 are welded together lengthwise as shown at welds 48 and 50. The lower end of outer housing shell 42 is welded flush with lower cylindrical surface 40 of housing 22 as indicated at weld 52 in FIG. 2.

The downwardly and slightly inwardly tapered annular surface 38 of housing 22 and a cylindrical inner surface 54 of outer housing shell 42 of housing 22 define an annular space or cavity 56 therebetween which may be said to be disposed within housing 22 concentrically about longitudinal passageway 24.

A plurality of threads 58 are formed on tapered surface 38 and the outer ends thereof closely engage inner surface 54 of outer housing shell 42.

The threads 58 may be generally described as a spiral guide means 58 located within the annular cavity 56 for defining a shape of annular cavity 56 in an upward spiral.

First and second supply passages 60 and 62 are disposed in housing 22 and communicate longitudinal passageway 24 with a lower portion 64 of annular cavity 56. Supply passageways 60 and 62 may generally be described as a means for taking a portion of drilling fluid from longitudinal passageway 24, and for directing said portion of drilling fluid into lower portion 64 of annular cavity 56.

As is best seen in FIG. 3, supply passage 60 has an inner end 66 which tangentially intersects a cross section of longitudinal passageway 24, and has an outer end 68 which joins with lower portion 64 of annular cavity 56 and is so oriented at said junction with annular cavity 56 that drilling fluid flowing from supply passage 60 in the direction indicated by arrow 70 has a velocity component indicated by the arrow 72 tangential to annular cavity 56.

The component of velocity of drilling fluid exiting supply passage 60 represented by the tangential component vector 72 imparts a swirling flow to the drilling fluid within the annular cavity 56 causing that fluid to flow clockwise within cavity 56 as seen in FIG. 3, i.e. as seen from above. This clockwise flow is indicated by an arrow 75. Passage 62 is constructed similar to passage 60.

The threads 58 shown in FIG. 2 comprise a lefthand thread so that the clockwise swirling drilling fluid will climb up the thread.

The desired upwardly swirling motion of the drilling fluid within the annular cavity 56 is initiated due to the tangential component 72 of velocity of the drilling fluid as it exits the supply passage 60 and 62 into the annular cavity 56. Even without the threads 58, to guide the fluid in a spiral pattern as it flows upward through cavity 56, the fluid would still have an upwardly swirling motion and therefore the cyclone sub 14 could be constructed without the threads 58.

An ejection passage means 74 is disposed in housing 22 and is defined between tapered surface 36 of inner spool 33 of housing 22 and an upward facing tapered surface 76 of outer housing shell 42 of housing 22. Ejection passage means 74 includes a circumferential opening 78 disposed in the outer cylindrical surface of housing 22.

The outer cylindrical surface of housing 22 includes the upper cylindrical surface portion 34 of inner spool 33, an outer cylindrical surface 80 of outer housing shell 42, and the lower cylindrical surface 40 of inner spool 33. The ejection passage means 74 disposed in housing 22 communicates an upper portion 82 of annular cavity 56 with the outer surface of housing 22.

The supply passages 60 and 62, annular cavity 56 and ejection passage means 74 may collectively be described as a transverse passageway 84 communicating longitudinal passageway 24 with the outer surface of housing 22 and with the annulus 21.

Due to the downward inward taper of surface 38 of housing 22, the cross-sectional area of annular cavity 56 decreases as fluid moves upward through annular cavity 56. This causes the velocity of the drilling fluid to increase as the fluid moves upward through cavity 56.

Either a junction 86 between the supply passage 60 and longitudinal passageway 24, or a junction 88 between supply passage 60 and longitudinal passage 24, or both junctions collectively, may be referred to as a flow dividing means for dividing a downward flow of drilling fluid in drill string 10, at a first elevation 90 (see approximate representation at FIG. 1) above drill bit 16, into a first stream and a second stream of drilling fluid.

The second stream of drilling fluid is directed downward through the lower portion of longitudinal passageway 24 located below junctions 86 and 88, which lower portion of longitudinal passageway 24 may also be considered to be a portion of drill string 10 located below first elevation 90, to the drill bit 16. From drill bit 16 the second stream of drilling fluid flows through three jet openings 15 between cones 17 to clean material from the cones 17 and wash cuttings away from the interface between the drill bit 16 and the formation 20. Then the second stream of drilling fluid flows upward through the annulus 21 between drill string 10 and borehole 12.

The first stream of drilling fluid is directed by the transverse passageway 84 from the longitudinal passageway 24 to the annulus 21 at a second elevation 91 above drill bit 16, with a velocity component tangential to the annulus 21, thereby imparting a swirling motion about drill string 10 to the upward flowing second stream of drilling fluid within annulus 21.

Figure 4:
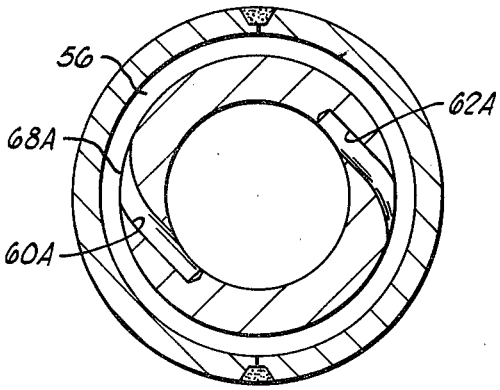
FIG. 4 is a sectional view similar to FIG. 3 showing an alternative embodiment of the supply passage means of the present invention.

Referring now to FIG. 4, a view similar to FIG. 3 is thereshown which has an alternative embodiment of the supply passages there illustrated and designated by the numerals 60A and 62A. The passage 60A is modified in that its outer end 68A is curved so that drilling fluid flowing from the supply passage 68A into the annular cavity 56 has a velocity directed substantially entirely tangential to annular cavity 56.

Figure 5:
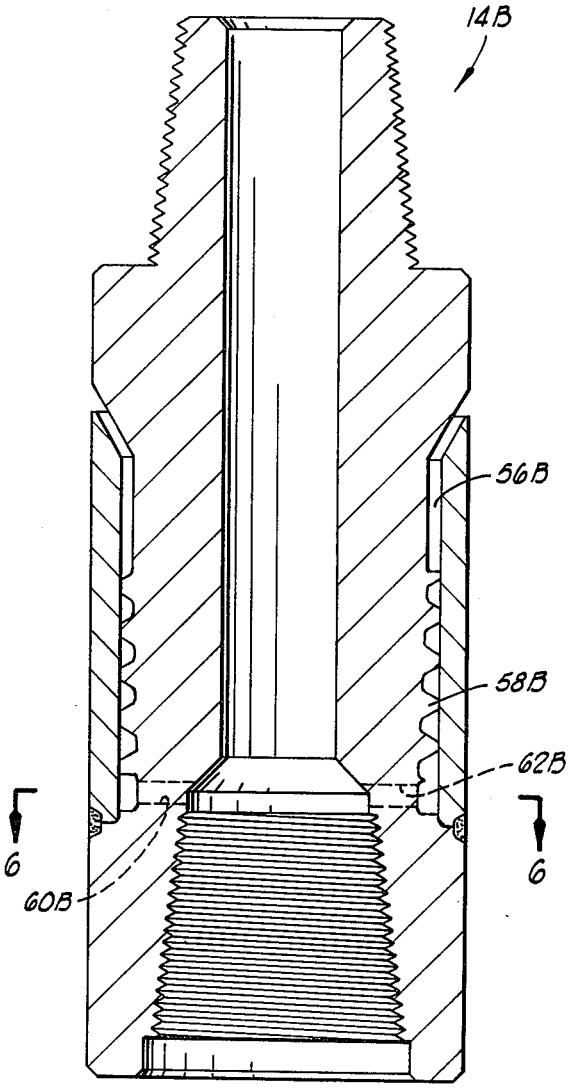
FIG. 5 is a sectional elevation view of an alternative embodiment of the present invention.

Referring now to FIG. 5, an alternative embodiment of the drilling sub of FIG. 2 is there designated by the numeral 14B.

Figure 6:
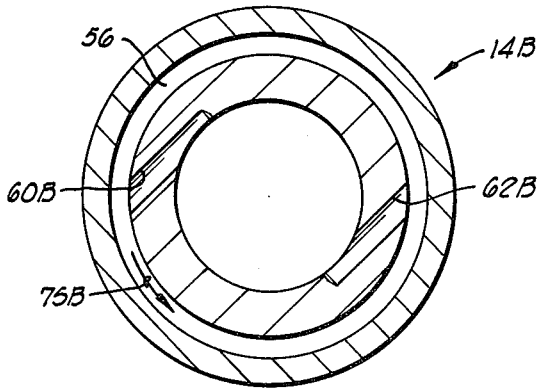
FIG. 6 is a sectional view along line 6—6 of FIG. 5.

The drilling sub 14B of FIG. 5 differs from the drilling sub 14 of FIG. 2 in that the threads 58B of drilling sub 14B comprise a righthand thread instead of a lefthand thread. Additionally, the supply passages 60B and 62B of drilling sub 14B are oriented when viewed from above as shown in FIG. 6, so that drilling fluid ejected from supply passages 60B and 62B into annular cavity 56B has a velocity component tangential to annular cavity 56B in a counter-clockwise direction as viewed from above, so that drilling fluid within the annular cavity 56B of drilling sub 14B spirals in a counter-clockwise direction as shown by the arrow 75B of FIG. 6.

This counter-clockwise flow as indicated by the arrow 75B then climbs up the righthand spiral defined by righthand threads 58B so that the drilling fluid within annular cavity 56 of drilling sub 14B has an upwardly counter-clockwise spiraling motion.

A conventional rotary drilling apparatus as schematically illustrated in FIG. 1 rotates the drilling string 10 to the right as viewed from above. This righthand rotation of the drill string 10 and the drilling bit 16 of course imparts a small clockwise motion, when viewed from above, to the drilling fluid within annulus 21 due merely to the viscous drag of the drilling fluid against the rotating drill string 10.

With the embodiment of FIGS. 2 and 3, the drilling fluid swirling clockwise and upward through the drilling sub 14 is injected into the annulus 21 and imparts an additional upward swirling motion to the drilling fluid within the annulus 21 in addition to any swirling motion created by rotation of the drill bit 16 and the drill string 10.

With the alternative embodiment of FIGS. 5 and 6, the motion of the drilling fluid swirling counter-clockwise and upward through the cavity 56B is rotating in a direction opposite to the direction of drill string 10 and therefore imparts an additional swirling motion to the well fluid in the annulus 21 in a direction opposite to the direction of motion created by viscous drag of the drill pipe 10 on the drilling fluid in the annulus 22. Due, however, to the very high velocities of drilling fluid exiting the annular cavity 56B, which velocities may approach Mach 0.5, any clockwise swirling of the drilling fluid due to viscous drag on the pipe string 12 is overcome so that the drilling fluid within annulus 21 swirls counter-clockwise as viewed from above, even though the drill string 10 is still rotating clockwise, as viewed from above. Of course, a very thin boundary layer near the drill string 10 would still be rotating in the same direction as the drill string 10.

The swirling motion imparted by the drilling fluid due to drag against the rotating drill string 10 is negligible since the rotational velocity of the outer surface of drill string 10 is very much lower than the fluid velocities created by the drilling sub 14 and the normal upward fluid velocity in annulus 21.

An additional effect of utilizing the alternative embodiment of FIGS. 5 and 6 is that turbulence is created due to the opposing direction of the forces exerted on the drilling fluid in the annulus 21 from the counter-clockwise swirling fluid ejected from annular cavity 56B as opposed to the clockwise forces due to viscous drag from the drill string 10.

It has been determined through experiments conducted with a drilling sub like that shown in FIG. 2, that the components thereof subjected to the high velocity swirling flow of drilling fluid within the transverse passage 84 suffer from severe wear. It is, therefore, desirable to provide a high strength very hard surface at such points of wear. This may be accomplished in any one of several manners as are shown for example in FIGS. 7, 8 and 9.

Figure 7:
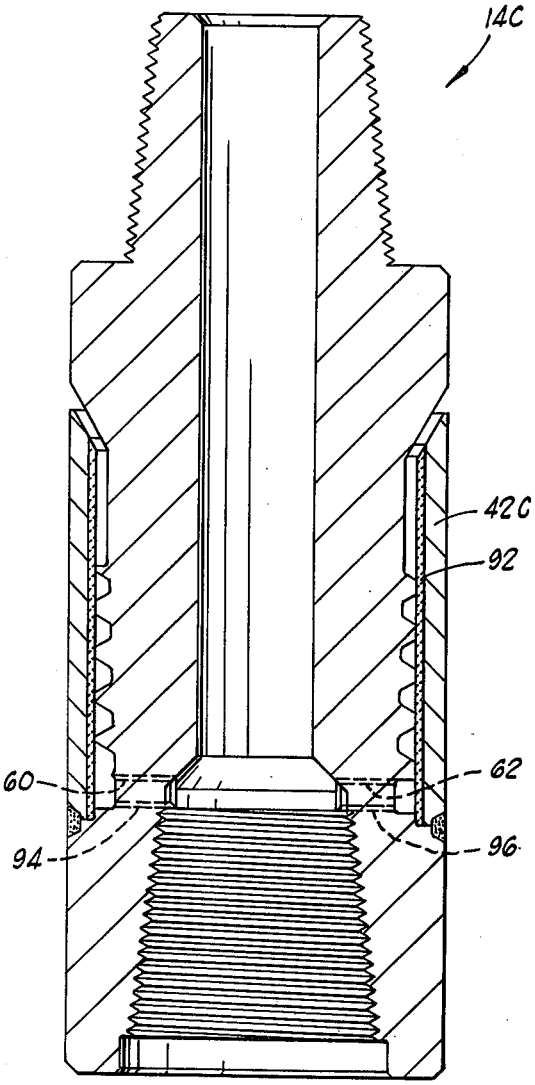
FIG. 7 is a view similar to FIG. 2 showing a modified version of the embodiment of FIG. 2.

In the drilling sub of FIG. 7, generally designated by the numeral 14C, the outer housing shell 42C includes a cylindrical liner 92. This liner is preferably constructed from an alumina ceramic. Alternatively, the inner cylindrical surface 54 of the drilling sub 14 of FIG. 2 could be hard-faced with a cemented carbide material. The insert sleeve 92 could also be formed of a carbide material.

Additionally, cylindrical ceramic inserts 94 and 96 are provided about supply passages 60 and 62, respectively.

In FIG. 8, a drilling sub 14D includes an additional form of surface protection provided by a sleeve 98 fitted around spool portion 33D of housing 22D. The sleeve 98 includes the teeth 58D which are also formed preferably from a ceramic material.

In FIG. 9, yet another alternative embodiment, generally designated by the numeral 14E, is shown which provides a spool portion 33E of the housing 22E having a smooth cylindrical outer surface 100 and which has a sleeve 102 fitted within outer housing shell 42E, which sleeve is preferably formed of ceramic and which includes teeth 58E which are integrally formed with the sleeve 102.

Numerous other forms of hard facing and inserts could be utilized for providing a high-wear surface at those points within the drilling sub of the present invention where extreme wear would otherwise be encountered by subjecting normal high strength steels to the abrasive action of the high velocity drilling mud.

The Embodiment of FIGS. 10 through 17

Figure 10:
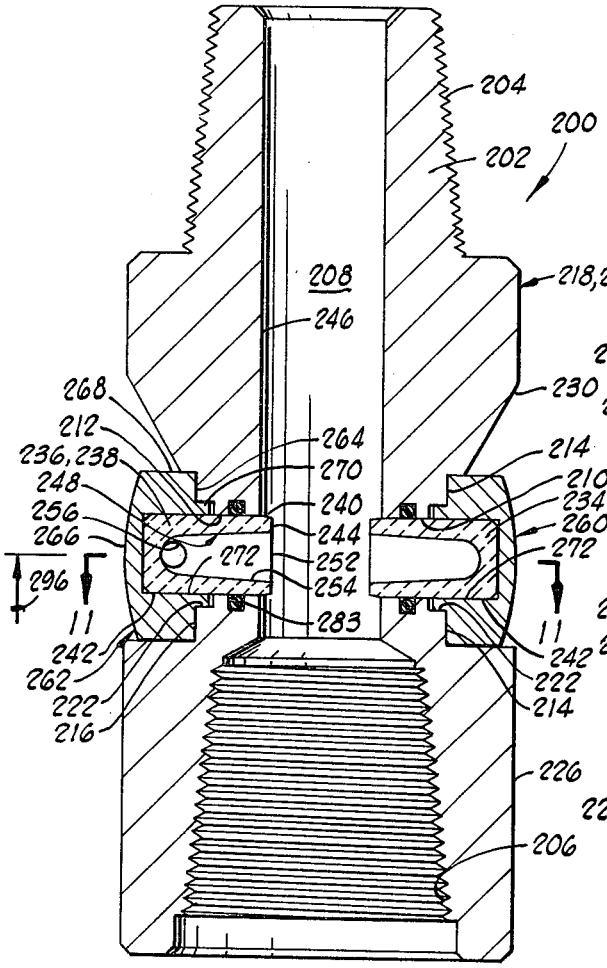
FIG. 10 is a sectional elevation view of another alternative embodiment of the drilling sub of the present invention.
Figure 13:
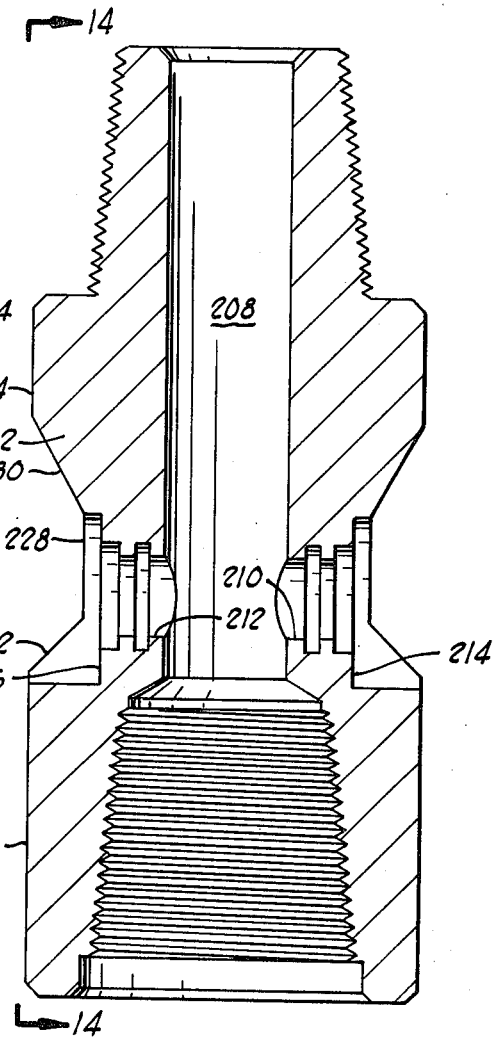
FIG. 13 is a sectional elevation view of the housing of the drilling sub of FIG. 10.

Referring now to FIG. 10, another embodiment of a drilling sub is shown and generally designated by the numeral 200. The drilling sub 200 may be used in place of the drilling sub 14 shown in FIG. 1.

The drilling sub 200 includes a cylindrical housing 202 having a threaded upper pin end 204 adapted to be connected to the drill string 10 and a threaded lower box end 206 adapted to be connected to the drill bit 16. Housing 200 further has a longitudinal passageway 203 disposed therethrough communicating its upper and lower ends.

Transverse openings 210 and 212, which preferably each comprise a radial bore, communicate longitudinal passageway 208 with first and second recessed surface portions 214 and 216 disposed in an outer surface 218 of housing 202.

Figure 14:
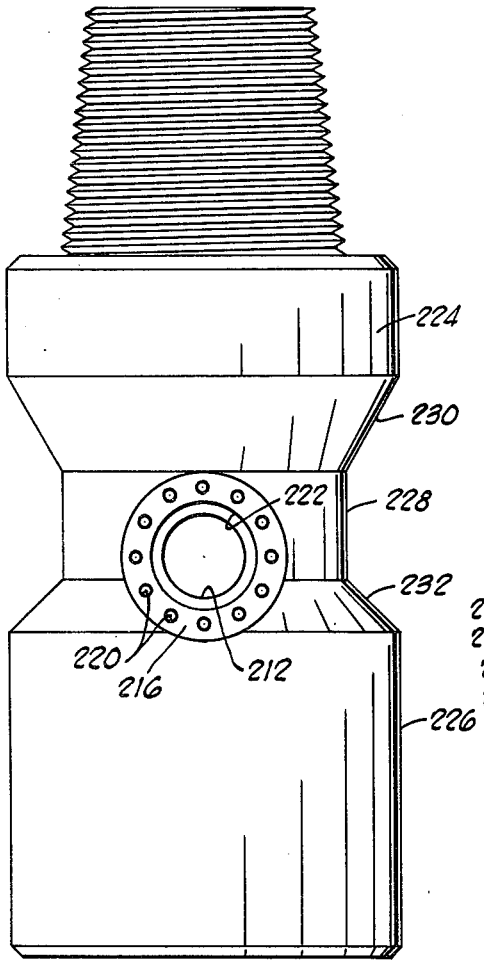
FIG. 14 is a left side elevation view of the housing of FIG. 13, taken along line 14—14 of FIG. 13.

As is best seen in FIG. 14, the recessed surface portion 216 is a planar annular surface centered about a radius of cylindrical housing 202 and having a plurality of threaded bores 220 disposed therein. A counterbore 222 communicates surface 216 with radial bore 212.

The entire outer surface 218 of cylindrical housing 202 is defined by an upper cylindrical portion 224, a lower cylindrical portion 226, a reduced diameter central cylindrical portion 228, an upper sloped annular shoulder 230 connecting upper cylindrical portion 224 and central cylindrical portion 228, a lower sloped annular shoulder 232 connecting lower cylindrical portion 226 with central cylindrical portion 228, and the recessed surfaces 214 and 216. This outer surface 218 may be further described as including an outer cylindrical surface (including upper and lower cylindrical portions 224 and 226) having an open cavity (defined by surfaces 228, 230, 232, 214 and 216) disposed therein.

First and second nozzles 234 and 236 are received within the transverse openings 210 and 212, respectively.

Figure 17:
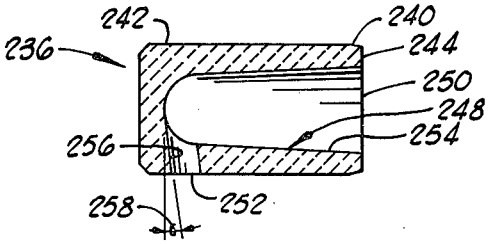
FIG. 17 is a section view of one of the ceramic jet nozzles of the drilling sub of FIG. 10.

The nozzles 234 and 236 are similarly constructed and in the interest of brevity, the details of only the nozzle 236 will be described. The nozzle 236 includes a cylindrical nozzle body 238 having a first end portion 240 received in radial bore 212 and a second end portion 242 extending outward past recessed surface 216. The nozzle 236 is best shown in FIG. 17.

Figure 11:
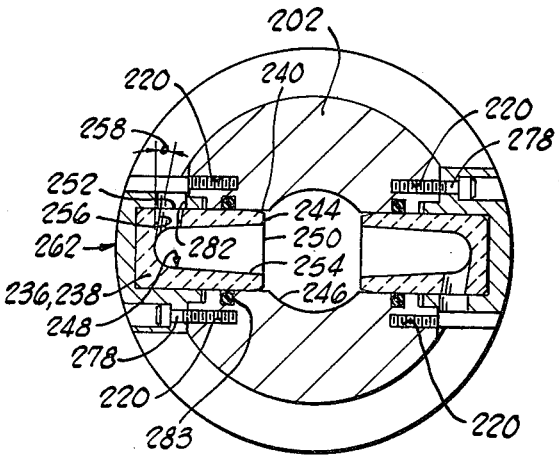
FIG. 11 is a section view along line 11—11 of FIG. 10.
Figure 12:
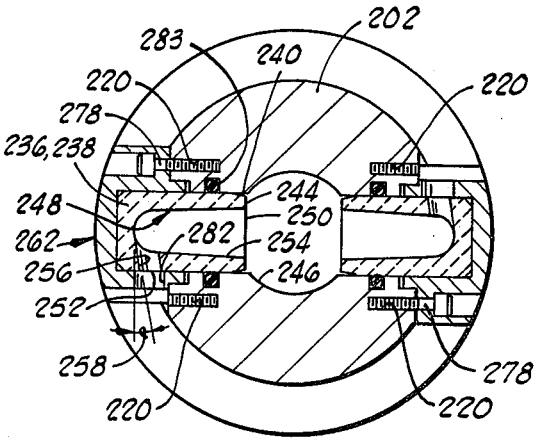
FIG. 12 is a view similar to FIG. 11 showing the jet nozzles oriented to produce a counter-clockwise swirling flow as viewed from above.

The first end portion 240 preferably extends into longitudinal passageway 208, as is best seen in FIGS. 11 and 12, so that an end face 244 thereof extends inward at least as far as the inner wall 246 defining longitudinal passageway 208. This places the wear from drilling fluid turning into nozzle 236 on the ceramic nozzle rather than on the steel wall 246.

Disposed in nozzle body 238 is a transverse passageway 248 communicating longitudinal passageway 208 with the annulus 21 between the drill string 10 and the bore hole 12. Transverse passageway 248 may also be said to connect the longitudinal passageway 208 with the outer surface 218 of cylindrical housing 202.

The transverse passageway 248 has a first end 250 communicated with longitudinal passageway 208 and a second end 252 (see FIGS. 11 and 12) oriented to eject drilling fluid therefrom into the annulus 21. First and second ends 250 and 252 of passageway 248 may also be referred to as an inlet and an outlet, respectively, of nozzle 236.

The transverse passageway 248 includes a tapered radial bore 254 and a cylindrical ejection bore 256. Thus, nozzle 236 has a restricted outlet 252 which has an inner diameter less than an inner diameter of the inlet 250 thereof. The passageway 248 through nozzle 236 is a nonlinear passageway because a central axis of its outlet 252 is not parallel with a central axis of its inlet 250.

As is best seen in FIGS. 11 and 12, the ejection bore 256 is preferably oriented at an angle 258 which in the case illustrated is approximately 10° relative to a line tangential to the longitudinal axis of the cylindrical nozzle body 236. This orients the jet of fluid exiting ejection bore 256 substantially entirely tangential to the annulus 21 or the outer surface 218 of the housing 202.

It will be understood that the annulus 21 is defined as all of that space between the drill string 10 and the borehole 12, and since the drilling sub 200 comprises a part of the drill string 10 the radially inner limit of the annulus 21 is therefore defined by the outer surface 218 of the housing 202.

The jet of fluid ejected into the annulus 21 is preferably substantially entirely tangential to the annulus 21 but the desired swirling effect of the fluid within the annulus 21 can be obtained so long as there is a substantial non-radial velocity component of the exiting fluid jet nozzle 236 in a plane normal to a longitudinal axis of the housing 202.

The open cavity defined by surfaces 228, 230, 232, 214 and 216 in the outer cylindrical surface 224, 226 provides a means for allowing drilling fluid ejected from nozzles 234 and 236 to be ejected directly through said open cavity into annulus 21 surrounding housing 202 without any substantial impingement upon any structure connected to housing 202.

The nozzles 234 and 236 are preferably constructed from a very high purity alumina ceramic material so as to be substantially resistant to erosion effects of the high velocity drilling fluid flowing therethrough.

First and second nozzle holder means 260 and 262 are attached to the recessed surfaces 214 and 216, respectively, of housing 202 for holding the nozzles 234 and 236 in place within the transverse openings 210 and 212, respectively.

The nozzle holder means 262 includes a flat annular surface 264 engaging recessed surface 216, a spherically curved radially outer surface 266, a cylindrical middle surface 268 joining surfaces 246 and 266, and a radially inward extending cylindrical stub 270 extending inward from surface 264.

Nozzle holder 262 includes a radial blind bore 272 open at the stub end 270. The second end 242 of nozzle 236 is closely received in bore 272 and is bonded thereto with epoxy.

The stub extension 270 of nozzle holder 262 is concentrically disposed about the nozzle 236 and is received within counterbore 222.

Figure 15:
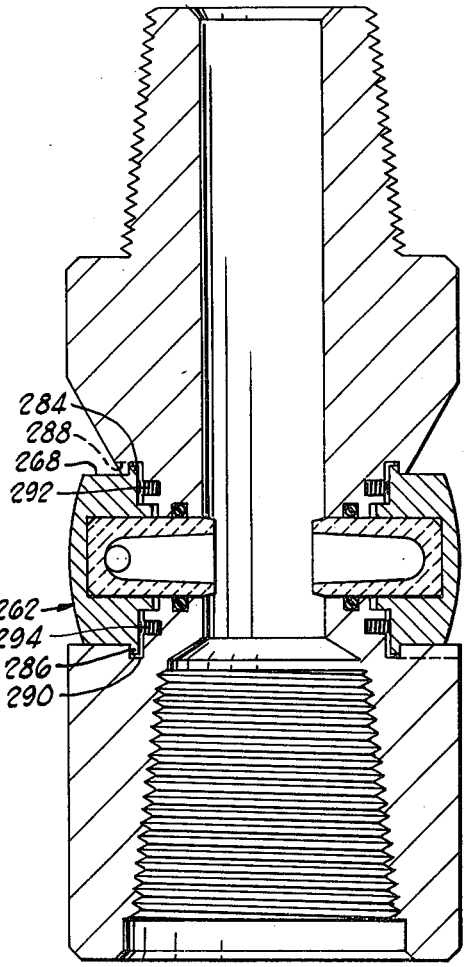
FIG. 15 is an outer end view of a jet nozzle holder means of the drilling sub of FIG. 10.
Figure 18:
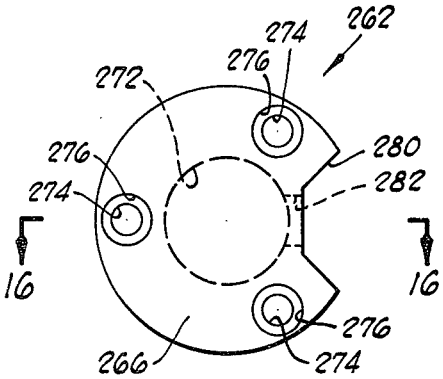
Figure 16:
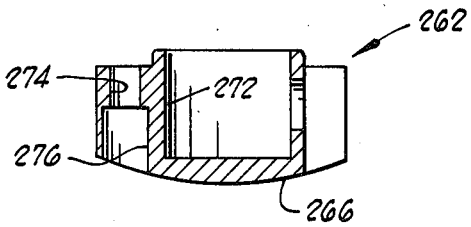
FIG. 16 is a section view along line 16—16 of FIG. 15.

The construction of the nozzle holder 262 is best seen in FIGS. 15 and 16. FIG. 15 is a radial end view of the spherical surface 266 and shows three bolt holes 274 disposed therethrough having counterbores 276 disposed thereabout.

As is seen in FIGS. 11 and 12, bolts 278 are disposed through bolt holes 274 and received in the threaded blind bores 220 of housing 202 to attach the nozzle holder means 262 to the housing 202.

The nozzle holder means 262 has a truncated pie shaped portion cut therefrom leaving a trapezoidal recess 280 therein as shown in FIG. 15. A side bore 282 is disposed in nozzle holder 262 and communicates the first bore 272 of nozzle holder 262 with the trapezoidal recess 280.

As can be seen in FIGS. 11 and 12, the ejection bore 256 of nozzle 236 is aligned with the side bore 282 of nozzle holder 262 so that fluid ejected from the ejection bore 256 may pass into the annulus 21.

An annular O-ring seal means 283 is disposed between the radial bore 212 and the nozzle body 36 to seal therebetween.

As mentioned, the nozzles 236 and 234 are preferably constructed of an alumina ceramic material. These materials are known in the art and combine many of the desirable properties of metal such as high strength, hardness and high temperature resistance with other desirable properties of plastic such as chemical resistance and good electrical properties. Such ceramic materials may, for example, be obtained from Coors Porcelain Company of Golden, Colorado.

Such alumina ceramic materials provide extremely hard surfaces with high compression strengths, but they are not nearly as strong in tension as they are in compression. It is therefore desirable that the nozzle holder means 262 be so arranged and constructed that it supports the nozzle 236 against all thrust forces exerted thereon by the fluids flowing through the nozzle 236 to thereby prevent any tensile loading of the ceramic nozzle 236.

The drilling sub 200 in FIG. 10, which is shown in horizontal cross section in FIG. 11, has the nozzles 236 and 238 oriented so as to cause a swirling motion of drilling fluid within the annulus 21 in a clockwise direction as viewed from above. This is in the same direction that the drill string 10 is rotating. FIG. 12 shows an alternative orientation of the nozzles 236 and 234 which creates a counter-clockwise swirling motion of drilling fluid within the annulus 21, which is in the opposite direction of the rotation of the drill string 10.

Both of these drawings illustrate the ejection bores such as ejection bore 256 of nozzle 236 oriented in a substantially horizontal plane. Although the ejection bore 256 may be oriented entirely in a horizontal plane, it often will be rotated about the longitudinal axis of the cylindrical nozzle body 238 so that the jet of drilling fluid ejected from ejection bore 236 will have both a horizontal velocity component tangential to the annulus 21 and a vertically upward velocity component.

The construction of the nozzle holder means 262 with the bolts 278 for attaching the same to the recessed surface 216 allows the nozzle holder means 262 to be rotated in increments of 30° due to the bolt pattern provided on the recessed surface 216. This is provided on the embodiment illustrated in FIG. 10 for the purpose of allowing the orientation of the ejection bore 256 to be varied so as to determine the most efficient orientation thereof to achieve the desired vortex effect in the drilling fluid in the annulus 21 as previously mentioned. The embodiment illustrated in FIGS. 10–14 substantially shows a prototype model of the present invention.

Figure 18:
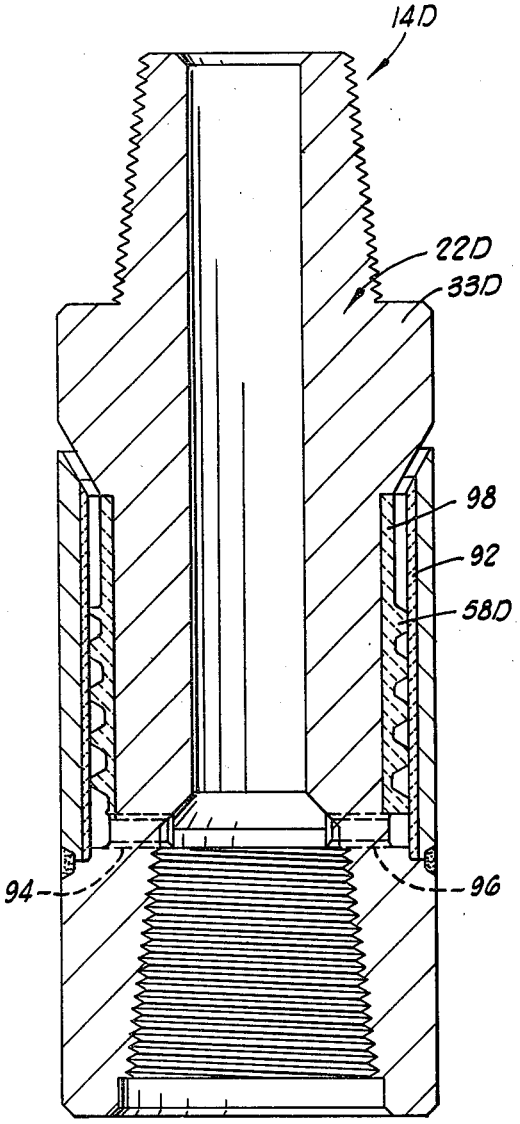
FIG. 18 is a sectional elevation view of the drilling sub of of FIG. 10 with a modified nozzle holder means.

It is envisioned that a final version of the drilling sub of the present invention to be marketed will have the nozzles and nozzle holders constructed so as to provide a fixed orientation of the ejection bore 256 designed for maximum performance in a given drilling situation. Preferably this permanent type holder would be constructed in a manner like that illustrated in FIG. 18 wherein the cylindrical outer surface 268 of nozzle holder 262 includes lugs 284 and 286 extending therefrom which are received within J-slots 288 and 290 disposed in housing 202 and which are resiliently held in place therein by compression springs 292 and 294.

The junctions between the inner ends such as inner end 250 of the transverse passageways disposed in the nozzles 234 and 236 and the longitudinal passageway 208 provide a means for dividing a downward flow of drilling fluid within the drill string 10 at a first elevation 296 as represented in FIG. 10 above drill bit 16 into a first stream and a second stream of drilling fluid.

The second stream of drilling fluid is directed downward through the longitudinal passageway 208 to the drill bit 16, then out through the jet openings 15 of nozzle 16 then upward through the annulus 21 between the drill string 10 and the borehole 12.

The first stream of drilling fluid is directed through the transverse passageways of the nozzles 234 and 236 into the annulus 21 at a second elevation above the drill bit 16. In the embodiment illustrated in FIG. 10 with the ejection bore 256 laying in a horizontal plane, the second elevation corresponds with the first elevation 296. If the ejection passage means 256 were rotated upward to add an upward velocity component to the jet of drilling fluid ejected therefrom, then the second elevation would be somewhat higher than the first elevation 296. Similarly, if it were desired to impart a downward motion to the fluid in the annulus 21 by directing the ejection bore 256 partially downward, the second elevation would be lower than the first elevation 296.

Regardless, the fluid ejected from the ejection bore 256 should be oriented so as to have a velocity component tangential to the annulus 21 to thereby impart a swirling motion about the drill string 10 to the upward flowing second stream of drilling fluid within the annulus 21.

Theory of Operation of the Downhole Vortex Generator

There are two components of force exerted upon a surface, such as the bottom of borehole 12, by a flowing fluid stream impinging thereon, such as the second stream of fluid flowing downward through jet orifice 15 of bit 16 against the bottom of borehole 12. Those two components are a hydrostatic component and an inertial component. Thus the pressure exerted upon the bottom of borehole 12 directly under jet orifices 15 when fluid is flowing downward through orifices 15 is greater than the pressure would be if the same fluid column were static.

Similarly, the pressure exerted upon that portion of the bottom of borehole 12 under the annulus 21 where the fluid above is flowing upward is less than the pressure that would be present if the same column of fluid were static.

This has been recognized by the prior art previously discussed, such as for example in U.S. Pat. No. 2,765,146 to Williams, Jr. where additional upward flow within the annulus is induced to decrease the pressure at the bottom of the borehole by increasing the upward inertia of the fluid column located above the bottom of the borehole.

Other methods have been proposed to reduce the pressure at the bottom of the borehole. U.S. Pat. No. 4,022,285 to Frank alleges to provide a structure wherein there is sufficient upward inertia provided to the fluid column in the annulus to entirely support the column and give a zero hydrostatic pressure at the bottom of the borehole.

U.S. Pat. No. 2,946,565 to Williams provides a seal across the annulus and then pumps the fluid from below the seal to above the seal, thereby reducing the hydrostatic head at the bottom of the borehole.

U.S. Pat. No. 3,958,651 to Young proposes air drilling which eliminates the weight of a liquid column at the borehole.

U.S. Pat. No. 3,923,109 proposes a rather complex arrangement of nozzles for providing cross-flow across the bottom of the borehole to remove the cuttings, and provides upwardly directed nozzles for inducing upward flow of the cuttings.

None of these references, however, have recognized the advantages that may be obtained by creating a vortex extending down to the drill bit, nor have they provided a structure for creating such a vortex.

By ejecting fluid tangentially into the annulus above the drill bit and thereby generating a vortex extending down to the drill bit a volume of decreased pressure is created at the radially inner portion of the vortex. This provides a sucking action which pulls cuttings away from the drill bit and also reduces the fluid pressure in the borehole near the drill bit. The swirling action also directs the fluid from jet orifices 15 across more of the surface area of the cones 17 of drill bit 16.

Although we do not yet fully understand this phenomena, the following explanation is believed to show the basic characteristics of the downhole vortex and its effect upon pressures within the borehole near the drill bit.

Figure 19:
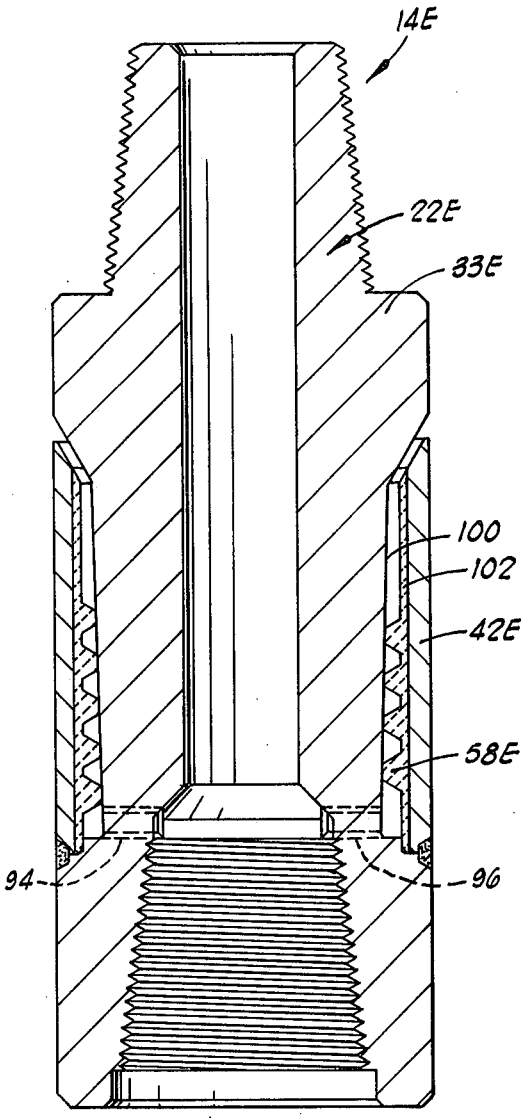
FIG. 19 is a schematic representation of a drill string in a borehole, superimposed upon a graphical vertical axis Z.
Figure 19:
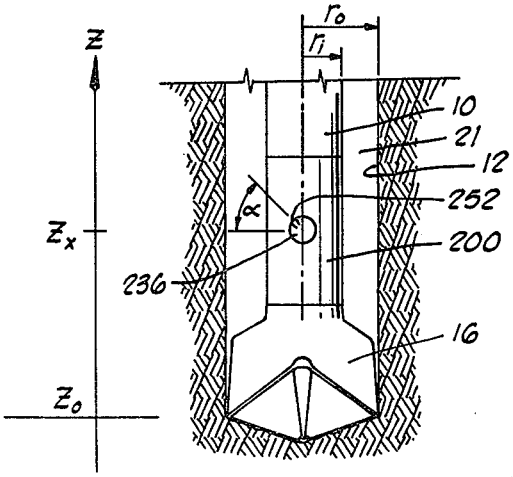

First, we construct a mathematical model of the problem. Referring to FIG. 19 a vertical axis Z is shown adjacent a representation of the drill string within the borehole. The bottom of the borehole 12 is represented on the Z-axis as $Z_o$. The elevation of the outlet 252 of nozzle 236 is represented on the Z-axis as $Z_x$. The angle to the horizontal at which the jet of fluid is ejected from outlet 252 of nozzle 236 is designated as $\alpha$. The radius of drilling sub 200 is designated as $r_i$, and the radius of bore hole 12 is designated as $r_o$, so that the annulus 21 is located between $r_i$ and $r_o$.

Figure 20:
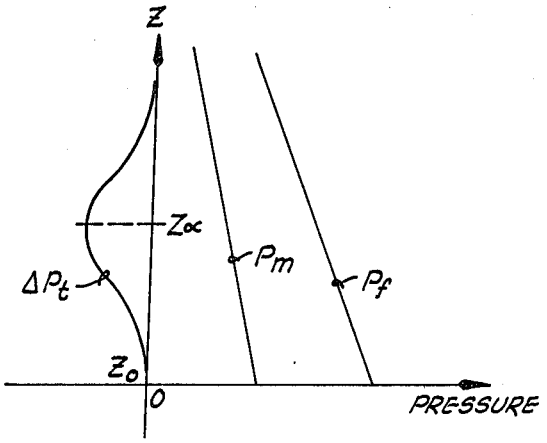
FIG. 20 is a graphical representation of formation pressure Pf, mud column pressure Pm, and the pressure decrease due to the vortex $\Delta Pt$.

Referring now to FIG. 20, several plots of pressure v. Z are shown. The curve labeled $P_f$ represents the rock stress or compression stress within the formation. The curve labeled $P_m$ presents the hydrostatic pressure of the mud column. The curve labeled $\Delta P_t$ represents the pressure decrease due to the vortex action created by the swirling flow adjacent nozzle 236.

The magnitudes of the curves are relative only, with $P_f > P_m > O$ for all Z, and with $\Delta P_t \leqq O$ for all Z.

The location of maximum $\Delta P_t$ on the Z-axis is designated as $Z_\alpha$ because that location depends upon $\alpha$, the angle at which the outlet 252 of nozzle 236 is oriented. If $\alpha = 0°$, then $Z_\alpha = Z_x$. If $0 < \alpha < 180°$, then $Z_\alpha > Z_x$. If $-180° < \alpha < 0°$, then $Z_\alpha < Z_x$.

The rock stress pressure differential $P_o$, in the absence of a vortex is given by:

$$P_o = P_f - P_m, \qquad \text{(Equation 1)}$$

and with the vortex is given by:

$$P_o = P_t - (P_m + \Delta P_t) \qquad \text{(Equation 2)}$$

The pressure of the fluid within the borehole represented by the term $(P_m + \Delta P_t)$ in Equation 2 pushes against the face of the formation and inhibits the breaking of the rock away from the formation by the drill bit 16. Thus, in order to increase the ability of the drill bit 16 to break away the rock, it is desirable that the fluid pressure within the borehole $(P_m + \Delta P_t)$ be made as low as possible.

The fluid pressure differential, $P_D$, in the absence of a vortex is given by:

$$P_D = P_m - P_{ff} \qquad \text{(Equation 1 A)}$$

and with the vortex is given by:

$$P_D = (P_m + \Delta P_t) - P_{ff} \qquad \text{(Equation 2 A)}$$

where $P_{ff}$ is the pressure of the formation fluid.

As previously mentioned, the fluid pressure differential is typically on the order of several hundred p.s.i. and may be as great as several thousand p.s.i. The hydrostatic pressure of the mud column $P_m$ must be greater than $P_{ff}$ in order to prevent blowouts, but a high fluid pressure differential has the undesirable side effect of holding cuttings down at the interface between the drill bit 16 and the formation 20.

The presence of the factor $\Delta P_t$ in Equations 2 and 2A, representing the reduction in pressure of the drilling fluid in the borehole within the area of influence of the vortex created by drilling sub 14, improves drilling efficiency by decreasing the force exerted against the formation rock thus allowing the formation rock to be broken away more easily and by reducing the force holding the cuttings against the formation face, thus improving cleaning of the borehole.

It is noted, however, that the determination of the proper design to achieve a desired $\Delta P_t$ is not a completely analytical process at present and requires some practical experience and experimentation for any given formation.

The following analytical description does point out those parameters which are currently believed to be important and practically variable in order to achieve the desired $\Delta P_t$ for any given problem.

It has been theoretically determined that $\Delta Pt$ is reasonably approximated by the following equation:

$$\Delta P_t = \frac{\rho U_{nt}^2}{2}\left[1 - \left(\frac{r_i}{r_o}\right)^2\right] \qquad \text{(Equation 3)}$$

when $\alpha = 0°$, where:

$\rho$ = density of drilling mud, and $U_{nt}$ = tangential velocity of drilling mud exiting nozzle 236.

If $\alpha \neq 0°$, then $\Delta P_t$ can be determined by merely substituting the horizontal tangential component of $U_{nt}$ for $U_{nt}$.

From a study of Equation 3 it can be seen that the following controllable physical parameters effect $\Delta P_t$.

The velocity of fluid exiting the nozzle, $U_{nt}$, can be varied by varying the flow rate of drilling fluid and/or by varying the diameter of ejection bore 256. Preferably the diameter of ejection bore 256 is varied by providing a set of ceramic nozzles which have different ejection bore diameters.

The ratio of $r_i/r_o$ can be varied by varying the outside diameter of drilling sub 200. This is accomplished by providing a plurality of different sizes of drilling subs for use with standard diameter drill bits.

The ejection angle $\alpha$ can also be varied to vary the horizontal component of $U_{nt}$. This can be done on the drilling sub 200 of FIG. 10 by unbolting the nozzle holder 262, rotating it, and then rebolting it to housing 202.

In one particular design of drilling sub 200, which has been designed primarily for prototype experimental work to further determine the optimum values of the various parameters discussed above, the value of $r_i$ is 6.5", which is intended for use in bore holes having $r_o$ of 8.75", $\alpha$ is variable, and a set of nozzles having ejection bore diameters in the range from $\frac{1}{4}$ inch to 13/32 inch is provided.

The use of such a drilling sub imparts a swirling motion to drilling fluid within the annulus 21 thereby creating a vortex extending down to the drill bit 16.

This vortex effect reduces the effective circulating density of the drilling fluid in the annulus 21 near the drill bit 16 and thereby decreases the pressure within the well bore 12 and decreases the hydrostatic pressure exerted against the face 18 of formation 20.

By way of example, if the density of mud in annulus 21 near sub 14 is 15 lbs/gas prior to use of drilling sub 14 or 200, the upwardly swirling motion imparted to the drilling mud within annulus 21 near drill bit 16 due to the drilling sub may reduce the effective circulating density of the drilling mud in that area to approximately 14.8 lbs/gal.

This has several favorable effects on the overall drilling operation. First, the decrease in hydrostatic pressure exerted on the face 18 of the formation 20 tends to decrease compressional forces on the rock material at the face 18 thereby making the rock material at face 18 easier to cut away.

Also, the vortex action tends to suck up fluid and materials contained therein in much the manner as a tornado or other vortex type flow does, and in some instances where the internal pressure of the formation 20 itself is very high, the rock at or very near the face 18 of formation 20 may actually be put in a reduced stated of compression, neutral, or in tension which makes it much easier to break away from the formation 20 thereby increasing the ease of drilling.

Additionally, the swirling type flow sweeping across the cutting elements of drill bit 16 aids in the cleaning of cuttings and other debris from the cutting elements, by way of deflecting the bit nozzle flow over a larger surface area of the cutting elements 17.

These benefits and advantages of the drilling subs 14 and 200 are provided by the use of the illustrated structures as defined in the following claims. The optimization of these parameters is a matter of degree and optimization is not necessary to enjoy the benefits and advantages of the invention.

While certain preferred embodiments of the invention have been illustrated for the purpose of this disclosure, numerous changes in the arrangement and construction of parts may be made by those skilled in the art, which changes are embodied in the scope and spirit of this invention as defined by the appended claims.

What is claimed is:

1. A method of drilling a well, comprising:

rotating a drill bit attached to a lower end of a drill string by rotating an upper end of said drill string, and thereby boring a well borehole;

dividing a downward flow of drilling fluid in said drill string, at a first elevation above said drill bit, into a first stream and a second stream;

directing said second stream of fluid downward, through a portion of said drill string below said first elevation, to said drill bit, then out at least one orifice of said drill bit, and then upward through an annulus between said drill string and said well borehole;

directing said first stream of fluid into said annulus, at a second elevation above said drill bit, with a velocity component tangential to said annulus; and thereby imparting a swirling motion in only one direction about said drill string to said upward flowing second stream of drilling fluid; and wherein said step of directing said first stream of fluid into said annulus includes steps of:

directing said first stream of fluid into a lower portion of an annular space disposed in a cylindrical housing with a velocity component tangential to said annular space at a point where said first stream of fluid enters said annular space, to thereby create a swirling motion of said first stream of fluid within said annular space within said housing;

flowing said swirling first stream of fluid upward through said annular space within said housing; and ejecting said upwardly swirling first stream of fluid from an upper portion of said annular space into said annulus.

2. The method of claim 1, wherein said step of directing said first stream of fluid into said annulus further includes a step of:

increasing a velocity of said first stream of drilling fluid, as it flows upward through said annular space, by decreasing a cross-sectional area of said annular space.

3. The method of claim 1, wherein:

said flowing step is further characterized as flowing said first stream of fluid upward through an upwardly spiraling annular space.

4. The method of claim 3, wherein:

said flowing step is further characterized as flowing said first stream of fluid upward through an upwardly left-hand spiraling annular space.

5. The method of claim 3, wherein:

said flowing step is further characterized as flowing said first stream of fluid upward through an upwardly right-hand spiraling annular space.

6. The method of claim 1, wherein:

said ejecting step is further characterized as ejecting said upwardly swirling first stream of fluid through an annular opening, circumscribing said housing, into said annulus.

7. The method of claim 1, 2, 3, 4, 5 or 6, wherein:

said imparting step is further characterized as imparting a sufficient swirling motion about said drill string to said upward flowing second stream of drilling fluid to create a vortex in said second stream extending downward to said drill bit.

8. The method of claim 1, 2, 3, 4, 5 or 6, wherein:

said imparting step is further characterized as imparting sufficient swirling motion to said upward flowing second stream of drilling fluid to thereby decrease a fluid pressure in said borehole at an interface between said drill bit and an underground formation being drilled by said drill bit to thereby increase a penetration rate of said drill bit as compared to rates achievable in the absence of said swirling motion of said upward flowing second stream of drilling fluid.

9. A drilling apparatus, comprising:

a rotatable drill string means, having a drill bit attached to a lower end thereof, for boring a well borehole by rotating an upper end of said drill string means;

flow dividing means for dividing a downward flow of drilling fluid in said drill string means, at a first elevation above said drill bit, into a first stream and a second stream;

means for directing said second stream of fluid downward, through a portion of said drill string means below said first elevation, to said drill bit, then out at least one orifice of said drill bit, and then upward through an annulus between said drill string means and said well borehole;

means for directing said first stream of fluid into said annulus, at a second elevation above said drill bit, with a velocity component tangential to said annulus, and thereby imparting a swirling motion in only one direction about said drill string means to said upward flowing second stream of drilling fluid;

a cylindrical housing having a longitudinal passageway disposed therethrough;

wherein said means for directing said second stream of fluid includes a lower portion of said longitudinal passageway located below said flowing dividing means;

wherein said means for directing said first stream of fluid includes a transverse passageway communicating said longitudinal passageway with said annulus;

wherein said flow dividing means includes a junction between said longitudinal passageway and said transverse passageway; and wherein said transverse passageway includes:

an annular cavity disposed in said housing around said longitudinal passageway;

a supply passage means for communicating said longitudinal passageway with said annular cavity, said supply passage means being oriented at a junction with said annular cavity so that said first stream of fluid flowing from said supply passage means into said annular cavity has a velocity component tangential to said annular cavity; and an ejection passage means for communicating said annular cavity with an outer surface of said housing.

10. The drilling apparatus of claim 9 wherein:

said supply passage means communicates said longitudinal passageway with a lower portion of said annular cavity; and said ejection passage means communicates an upper portion of said annular cavity with said outer surface of said housing.

11. The drilling apparatus of claim 10, further comprising:

spiral guide means, located in said annular cavity, for defining a shape of said annular cavity in an upward spiral.

12. The drilling apparatus of claim 11, wherein:

said supply passage means is further characterized as being so oriented that said tangential velocity component of said first stream of fluid flowing therefrom is in a clockwise direction as viewed from above; and said spiral guide means is further characterized as being a left-hand spiral.

13. The drilling apparatus of claim 11, wherein:

said supply passage means is further characterized as being so oriented that said tangential velocity component of said first stream of fluid flowing therefrom is in a counter-clockwise direction as viewed from above; and said spriral guide means is further characterized as being a right-hand spiral.

14. The drilling apparatus of claim 10, wherein:

said annular cavity is further characterized as having an upwardly decreasing cross-sectional area.

15. The drilling apparatus of claim 10, wherein:

said ejection passage means includes a circumferential opening disposed in said outer surface of said housing.

16. The drilling apparatus of claim 10, wherein:

said supply passage means is further characterized as being so oriented at its junction with said annular cavity that the velocity of said first steam of fluid flowing from said supply passage means into said cavity is substantially entirely tangential to said annular cavity.

17. The drilling apparatus of claim 9, 10, 11, 12, 13, 14, 15, or 16, wherein:

said means for directing said first stream of fluid into said annulus and thereby imparting a swirling motion to said second stream of fluid is further characterized as a means for imparting a sufficient swirling motion about said drill string means to said upward flowing second stream of drilling fluid to create a vortex in said second stream extending downward to said drill bit.

18. The drilling apparatus of claim 9, 10, 11, 12, 13, 14, 15 or 16, wherein:

said means for directing said first stream of fluid into said annulus and thereby imparting a swirling motion to said second stream of fluid is further characterized as a means for imparting a sufficient swirling motion to said upward flowing second stream of drilling fluid to thereby decrease a fluid pressure in said borehole at an interface between said drill bit and an underground formation being drilled by said drill bit to thereby increase a penetration rate of said drill bit as compared to rates achievable in the absence of said swirling motion of said upward flowing second stream of drilling fluid.

19. A drilling apparatus, comprising:

a rotatable drill string means, having a drill bit attached to a lower end thereof, for boring a well borehole by rotating an upper end of said drill string means;

flow dividing means for dividing a downward flow of drilling fluid in said drill string means, at a first elevation above said drill bit, into a first stream and a second stream;

means for directing said second stream of fluid downward, through a portion of said drill string means below said first elevation, to said drill bit, then out at least one orifice of said drill bit, and then upward through an annulus between said drill string means and said well borehole;

means for directing said first stream of fluid into said annulus, at a second elevation above said drill bit, with a velocity component tangential to said annulus, and thereby imparting a swirling motion in only one direction about said drill string means to said upward flowing second stream of drilling fluid;

a cylindrical housing having a longitudinal passageway disposed therethrough;

wherein said means for directing said second stream of fluid includes a lower portion of said longitudinal passageway located below said flowing dividing means;

wherein said means for directing said first stream of fluid includes a transverse passageway communicating said longitudinal passageway with said annulus;

wherein said flow dividing means includes a junction between said longitudinal passageway and said transverse passageway; and a transverse opening disposed in said housing and communicating said longitudinal passageway with an exterior of said housing; and a nozzle received in said transverse opening and having said transverse passageway disposed therethrough with a first end communicated with said longitudinal passageway and a second end oriented to eject fluid therefrom into said annulus.

20. The drilling apparatus of claim 19, wherein:

said nozzle is constructed from a ceramic material; and said drilling apparatus further comprises nozzle holder means, attached to said housing, for holding said ceramic nozzle in place in said transverse opening of said housing.

21. The drilling apparatus of claim 20, wherein:

said nozzle holder means and said nozzle are so arranged and constructed that said nozzle holder means supports said nozzle against all thrust forces exerted on said nozzle by fluid passing therethrough to thereby prevent any tensile loading of said ceramic nozzle.

22. The drilling apparatus of claim 19, wherein:

said housing includes a recessed surface disposed in an outer cylindrical surface thereof;

said transverse opening is a radial bore communicating said longitudinal passageway with said recessed surface; and said nozzle includes a cylindrical nozzle body having a first end received in said radial bore and a second end extending past said recessed surface, said first end of said transverse passageway being disposed in said first end of said nozzle body and said second end of said transverse passageway being disposed in a portion of said nozzle body extending past said recessed surface.

23. The drilling apparatus of claim 22, further comprising:

annular seal means disposed between said cylindrical nozzle body and said radial bore for sealing therebetween.

24. The drilling apparatus of claim 22, further comprising:

nozzle holder means having a cylindrical recess disposed therein within which is received said second end of said nozzle body, said nozzle holder means being attached to said housing and having an opening therein communicating said second end of said transverse passageway with said outer cylindrical surface of said housing.

25. The drilling apparatus of claims 19, 20, 21, 22, 23 or 24, wherein:

said means for directing said first stream of fluid into said annulus and thereby imparting a swirling motion to said second stream of fluid is further characterized as a means for imparting a sufficient swirling motion about said drill string means to said upward flowing second stream of drilling fluid to create a vortex in said second stream extending downward to said drill bit.

26. The drilling apparatus of claims 19, 20, 21, 22, 23 or 24, wherein:

said means for directing said first stream of fluid into said annulus and thereby imparting a swirling motion to said second stream of fluid is further characterized as a means for imparting a sufficient swirling motion to said upward flowing second stream of drilling fluid to thereby decrease a fluid pressure in said borehole at an interface between said drill bit and an underground formation being drilled by said drill bit to thereby increase a penetration rate of said drill bit as compared to rates achievable in the absence of said swirling motion of said upward flowing second stream of drilling fluid.

27. A drilling apparatus comprising:

a cylindrical housing having an upper end adapted to be connected to a drill string and a lower end adapted to be connected to a drill bit;

a longitudinal passageway disposed through said housing; and a transverse passageway means, disposed in said housing with a first end communicated with said longitudinal passageway and a second end communicated with an outer surface of said housing, for taking a portion of drilling fluid from said longitudinal passageway and for ejecting said portion of drilling fluid from said second end of said transverse passageway means with a non-radial velocity component in a plane normal to a longitudinal axis of said housing, said transverse passageway means including:

an annular cavity disposed in said housing around said longitudinal passageway;

a supply passage means for communicating said longitudinal passageway with said annular cavity, said supply passage means being oriented at a junction with said annular cavity so that said first stream of fluid flowing from said supply passage means into said annular cavity has a velocity component tangential to said annular cavity; and an ejection passage means for communicating said annular cavity with said outer surface of said housing.

28. The drilling apparatus of claim 27, wherein:

said supply passage means communicates said longitudinal passageway with a lower potion of said annular cavity; and said ejection passage means communicates an upper portion of said annular cavity said said outer surface of said housing.

29. The drilling apparatus of claim 28, further comprising:

spiral guide means, located in said annular cavity, for defining a shape of said annular cavity in an upward spiral.

30. The drilling apparatus of claim 29, wherein:

said supply passage means is further characterized as being so oriented that said tangential velocity component of said first stream of fluid flowing therefrom is in a clockwise direction as viewed from above; and said spiral guide means is further characterized as being a left-hand spiral.

31. The drilling apparatus of claim 30, wherein:

said supply passage means is further characterized as being so oriented that said tangential velocity component of said first stream of fluid flowing therefrom is in a counter-clockwise direction as viewed from above; and said spiral guide means is further characterized as being a right-hand spiral.

32. The drilling apparatus of claim 27, wherein:

said annular cavity is further characterized as having an upwardly decreasing cross-sectional area.

33. The drilling apparatus of claim 27, wherein:

said ejection passage means includes a circumferential opening disposed in said outer surface of said housing.

34. The drilling apparatus of claim 27, wherein:

said supply passage means is further characterized as being so oriented at its junction with said annular cavity that the velocity of said first stream fluid flowing from said intermediate passage means into said cavity is substantially entirely tangential to said annular cavity.

35. A drilling apparatus comprising:

a cylindrical housing having an upper end adapted to be connected to a drill string and a lower end adapted to be connected to a drill bit;

an open cavity disposed in an outer cylindrical surface of said housing;

a longitudinal passageway disposed through said housing; and a transverse passageway means, disposed in said housing with a first end communicated with said longitudinal passageway and a second end communicated with said open cavity, for taking a portion of drilling fluid from said longitudinal passageway and for ejecting said portion of drilling fluid from said second end of said transverse pasageway means with a non-radial velocity component in a plane normal to a longitudinal axis of said housing, said open cavity having a cross-sectional area perpendicular to a central axis of said second end of said transverse passageway means substantially greater than a cross-sectional area of said second end of said transverse passageway means perpendicular to said central axis thereof.

36. The drilling apparatus of claim 35, further comprising:

a transverse opening disposed in said housing and communicating said longitudinal passageway with said open cavity; and a nozzle received in said transverse opening and having said transverse passageway means disposed therethrough.

37. The drilling apparatus of claim 35, wherein:

said open cavity is further characterized as being a means for allowing said portion of drilling fluid to be ejected directly into an annulus surrounding said cylindrical housing without any substantial impingement upon any structure connected to said housing.

38. A drilling apparatus comprising:

a cylindrical housing having an upper end adapted to be connected to a drill string and a lower end adapted to be connected to a drill bit;

an open cavity disposed in an outer cylindrical surface of said housing;

a longitudinal passageway disposed through said housing;

a transverse passageway means, disposed in said housing with a first end communicated with said longitudinal passageway and a second end communicated with said open cavity, for taking a portion of drilling fluid from said longitudinal passageway and for ejecting said portion of drilling fluid from said second end of said transverse pasageway means with a non-radial velocity component in a plane normal to a longitudinal axis of said housing;

a transverse opening disposed in said housing and communicating said longitudinal passageway with said open cavity;

a nozzle received in said transverse opening and having said transverse passageway means disposed therethrough; and wherein said nozzle includes an inlet and a restricted outlet, an inner diameter of said restricted outlet being smaller than an inner diameter of said inlet.

39. The drilling apparatus of claim 38, wherein:

said transverse passageway means is a non-linear transverse passageway means having a central axis of said nozzle inlet non-parallel to a central axis of said nozzle outlet.

40. The drilling apparatus of claim 38, wherein:

said open cavity and said nozzle outlet are so arranged and constructed that said portion of drilling fluid is ejected from said restricted outlet of said nozzle directly through said open cavity into an annulus surrounding said cylindrical housing without any substantial impingement upon any structure connected to said housing.

41. A drilling apparatus comprising:

a cylindrical housing having an upper end adapted to be connected to a drill string and a lower end adapted to be connected to a drill bit;

an open cavity disposed in an outer cylindrical surface of said housing;

a longitudinal passageway disposed through said housing;

a transverse passageway means, disposed in said housing with a first end communicated with said longitudinal passageway and a second end communicated with said open cavity, for taking a portion of drilling fluid from said longitudinal passageway and for ejecting said portion of drilling fluid from said second end of said transverse pasageway means with a non-radial velocity component in a plane normal to a longitudinal axis of said housing;

a transverse opening disposed in said housing and communicating said longitudinal passageway with said open cavity;

a nozzle received in said transverse opening and having said transverse passageway means disposed therethrough; and wherein said open cavity is partially defined by a flat surface intersecting said transverse opening.

42. A drilling apparatus comprising:

a cylindrical housing having an upper end adapted to be connected to a drill string and a lower end adapted to be connected to a drill bit;

an open cavity disposed in an outer cylindrical surface of said housing;

a longitudinal passageway disposed through said housing;

a transverse passageway means, disposed in said housing with a first end communicated with said longitudinal passageway and a second end communicated with said open cavity, for taking a portion of drilling fluid from said longitudinal passageway and for ejecting said portion of drilling fluid from said second end of said transverse pasageway means with a non-radial velocity component in a plane normal to a longitudinal axis of said housing;

a transverse opening disposed in said housing and communicating said longitudinal passageway with said open cavity;

a nozzle received in said transverse opening and having said transverse passageway means disposed therethrough; and annular resilient seal means between said nozzle and said transverse opening.

43. The drilling apparatus of claim 42, wherein:

said seal means includes an elastomeric O-ring received in an annular sealing groove disposed in said transverse opening.

44. A drilling apparatus comprising:

a cylindrical housing having an upper end adapted to be connected to a drill string and a lower end adapted to be connected to a drill bit;

an open cavity disposed in an outer cylindrical surface of said housing;

a longitudinal passageway disposed through said housing;

a transverse passageway means, disposed in said housing with a first end communicated with said longitudinal passageway and a second end communicated with said open cavity, for taking a portion of drilling fluid from said longitudinal passageway and for ejecting said portion of drilling fluid from said second end of said transverse pasageway means with a non-radial velocity component in a plane normal to a longitudinal axis of said housing;

a transverse opening disposed in said housing and communicating said longitudinal passageway with said open cavity;

a nozzle received in said transverse opening and having said transverse passageway means disposed therethrough;

wherein said nozzle is constructed from a ceramic material; and wherein said drilling apparatus further comprises nozzle holder means, attached to said housing, for holding said ceramic nozzle in place in said transverse opening of said housing.

45. The drilling apparatus of claim 44, wherein:

said nozzle holder means and said nozzle are so arranged and constructed that said nozzle holder means supports said nozzle against all thrust forces exerted on said nozzle by fluid passing therethrough to thereby prevent any tensile loading of said ceramic nozzle.

46. A drilling apparatus comprising:

a cylindrical housing having an upper end adapted to be connected to a drill string and a lower end adapted to be connected to a drill bit;

an open cavity disposed in an outer cylindrical surface of said housing;

a longitudinal passageway disposed through said housing;

a transverse passageway means, disposed in said housing with a first end communicated with said longitudinal passageway and a second end communicated with said open cavity, for taking a portion of drilling fluid from said longitudinal passageway and for ejecting said portion of drilling fluid from said second end of said transverse pasageway means with a non-radial velocity component in a plane normal to a longitudinal axis of said housing;

a transverse opening disposed in said housing and communicating said longitudinal passageway with said open cavity;

a nozzle received in said transverse opening and having said transverse passageway means disposed therethrough;

wherein said housing includes a recessed surface disposed in said outer cylindrical surface thereof;

wherein said transverse opening is a radial bore communicating said longitudinal passageway with said recess surface; and wherein said nozzle includes a cylindrical nozzle body having a first end received in said radial bore and a second end extending past said recessed surface into said open cavity, said first end of said transverse passageway means being disposed in said first end of said nozzle body and said second end of said transverse passageway means being disposed in a portion of said nozzle body extending past said recessed surface.

47. The drilling apparatus of claim 46, further comprising:

nozzle holder means having a cylindrical recess disposed therein within which is received said second end of said nozzle body, said nozzle holder means being attached to said housing and having an opening therein communicating said second end of said transverse passageway means with said open cavity.

* * * * *

UNITED STATES PATENT AND TRADEMARK OFFICE

CERTIFICATE OF CORRECTION

PATENT NO. : 4,436,166

DATED : March 13, 1984

INVENTOR(S) : Asadollah Hayatdavoudi and Ladd M. Adams

It is certified that error appears in the above-identified patent and that said Letters Patent are hereby corrected as shown below:

Column 2, line 7, delete "hole-down" and insert --hold-down--.
Column 4, line 62, delete "of", second occurrence.
Column 5, line 9, delete "seqments" and insert --segments--.
Column 13, line 50, delete "≦" and insert -- ≤ --.
Column 15, line 27, delete "gas" and insert --gal--; line 44, delete "stated" and insert --state--.
Column 18, line 18, delete "spriral" and insert --spiral--.
Column 20, line 66, delete "potion" and insert --portion--.
Column 21, line 1, delete "said", second occurrence, and insert --with--; line 16, delete "30" and insert --29--; line 52, delete "pasageway" and insert --passageway--.
Column 22, lines 22 and 62, delete "pasageway" and insert --passageway--.
Column 23, lines 19 and 48, delete "pasageway" and insert --passageway--.
Column 24, line 26, delete "pasageway" and insert --passageway--.

Signed and Sealed this

Twenty-ninth Day of May 1984

[SEAL]

Attest:

GERALD J. MOSSINGHOFF

Attesting Officer

Commissioner of Patents and Trademarks